US005362374A

United States Patent [19]

Chang

[11] Patent Number: 5,362,374

[45] Date of Patent: Nov. 8, 1994

[54] METHOD FOR MAKING DECORATIVE STICKERS

[76] Inventor: Jung-Ming Chang, No. 27, Lane 125, Sec. 4, San-Ho Rd., Sanchung City, Taipei Hsien,

[21] Appl. No.: 112,414

[22] Filed: Aug. 27, 1993

[51] Int. Cl.[5] ..... C25D 5/00

[52] U.S. Cl. ..... 205/164; 205/159; 205/196

[58] Field of Search ..... 205/159, 164, 194, 196, 205/224

[56] References Cited

U.S. PATENT DOCUMENTS 4,517,044 5/1985 Arnold ..... 428/914

5,207,851 5/1993 Abrams ..... 11/4

*Primary Examiner*—John Niebling

*Assistant Examiner*—Kishor Mayekar

*Attorney, Agent, or Firm*—Wells, St. John, Roberts, Gregory & Matkin

[57] ABSTRACT

The method for making a decorative sticker includes the steps of (a) providing a polyester (trade name: Tetoron) base film which has a top surface and a bottom surface, (b) applying a metal coating on the polyester base film by electroplating so that the top and bottom surfaces of the polyester base film can sparkle in the presence of bright light, (c) applying a hot-melt adhesive layer on the bottom surface of the polyester base film, (d) attaching a release paper to the hot-melt adhesive layer, (e) applying a binder layer with a predetermined figure on a predetermined part of the top surface of the polyester base film, (f) printing a first desired pattern on the remaining part of the top surface of the polyester base film by pressing the remaining part with ink, (g) printing a second desired pattern on the remaining part of the top surface of the polyester base film by pressing the remaining part with gold foil, (h) die-cutting the polyester base film on the top surface thereof so as to form a predetermined shape on the polyester base film, (i) applying an amount of liquid epoxy on the binder layer, the liquid epoxy spreading so as to conform with the predetermined figure of the binder layer, and (j) drying the liquid epoxy to form a transparent epoxy layer.

3 Claims, 1 Drawing Sheet

METHOD FOR MAKING DECORATIVE STICKERS

BACKGROUND OF THE INVENTION

1. Field Of The Invention

This invention relates to a method for making decorative stickers, more particularly to a method for making improved decorative stickers which provide a crystalline effect and which have an adhesive layer with strong adhesive force.

2. Description Of The Related Art

Decorative stickers are attached to clothes, shoes, bags, etc. in order to provide a pleasant appearance thereon. The method for making a conventional decorative sticker includes the steps of providing a PVC (polyvinylethylene) base film which has a top surface and a bottom surface, applying a glue layer on the bottom surface of the PVC base film, attaching a release paper to the glue layer, applying a colored layer on the top surface of the PVC base film by vacuum-plating the PVC base film, printing desired patterns on the top surface of the PVC base film by pressing the top surface with gold foil, and die-cutting the PVC base film on the top surface thereof. In this way, decorative stickers with predetermined patterns can be made.

The drawbacks of the above manufacturing method are as follows:

(1) Generally, the glue is heated so as to be applied easily on the bottom surface of the PVC base film. Because the PVC base film has a low heat resistance and may melt at about 60° C. to 70° C., it is easily damaged by heat when the glue is applied on the bottom surface of the PVC base film. Therefore, a PVC base film of a greater thickness, such as 100μ, is needed in order to prevent damage thereto. However, the great thickness of the PVC base film will provide an unpleasant appearance when the decorative sticker is attached to clothes.

(2) Due to the low heat resistance of the PVC base film and to the high temperature required (typically 120° C.) when printing desired patterns with gold foil, an additional device is used to control the manufacturing temperature when applying the glue layer on the bottom surface of the PVC base film and when printing desired patterns on the top surface of the PVC base film by pressing the top surface with gold foil in order to prevent damage to the PVC base film.

(3) Because the glue layer has a low adhesive force, the decorative sticker cannot be attached firmly to clothes. Therefore, the decorative sticker easily detaches from clothes during washing.

(4) Finally, the patterns formed on the conventional decorative stickers cannot provide a crystalline effect.

SUMMARY OF THE INVENTION

Therefore, the objective of this invention is to provide a method for making improved decorative stickers which provide a crystalline effect and which have an adhesive layer with a strong adhesive force. With the method of this invention, the additional device used in the prior art for controlling the manufacturing temperature is not necessary.

Accordingly, the method of this invention includes the steps of: (a) providing a polyester (trade name: Tetoron) base film which has a top surface and a bottom surface; (b) applying a metal coating on the polyester base film by electroplating so that the top and bottom surfaces of the polyester base film can sparkle in the presence of bright light; (c) applying a hot-melt adhesive layer on the bottom surface of the polyester base film; (d) attaching a release paper to the hot-melt adhesive layer; (e) applying a binder layer with a predetermined figure on a predetermined part of the top surface of the polyester base film; (f) printing a first desired pattern on the remaining part of the top surface of the polyester base film by pressing the remaining part with ink; (g) printing a second desired pattern on the remaining part of the top surface of the polyester base film by pressing the remaining part with gold foil; (h) die-cutting the polyester base film on the top surface thereof so as to form a predetermined shape on the polyester base film; (i) applying an amount of liquid epoxy on the binder layer, the liquid epoxy spreading so as to conform with the predetermined figure of the binder layer; and (j) drying the liquid epoxy so as to form a transparent epoxy layer.

BRIEF DESCRIPTION OF THE DRAWINGS

Other features and advantages of the present invention will become apparent in the following detailed description of the preferred embodiment, with reference to the accompanying drawings, in which.

DETAILED DESCRIPTION OF THE PREFERRED EMBODIMENT

Figure 1:
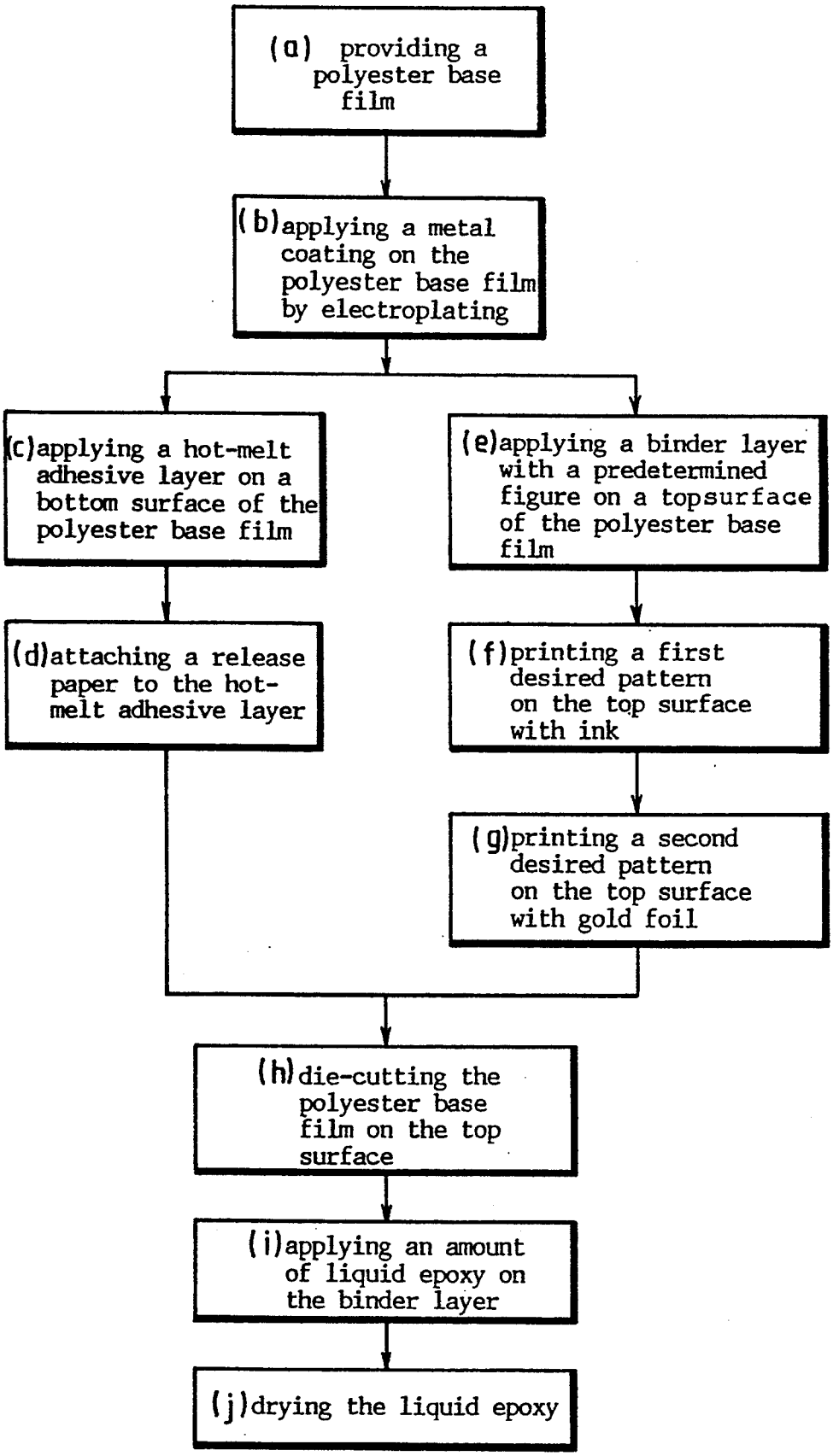
FIG. 1 is a flow diagram showing the steps of the manufacturing method of this invention.

FIG. 1 is a flow diagram illustrating the steps for manufacturing an improved decorative sticker in accordance with this invention. The manufacturing method includes the steps of: (a) providing a polyester (trade name: Tetoron) base film which has a top surface and a bottom surface; (b) applying a metal coating on the polyester base film by electroplating so that the top and bottom surfaces of the polyester base film can sparkle in the presence of bright light; (c) applying a hot-melt adhesive layer on the bottom surface of the polyester base film; (d) attaching a release paper to the hot-melt adhesive layer; (e) applying a binder layer with a predetermined figure on a predetermined part of the top surface of the polyester base film; (f) printing a first desired pattern on the remaining part of the top surface of the polyester base film by pressing the remaining part with ink; (g) printing a second desired pattern on the remaining part of the top surface of the polyester base film by pressing the remaining part with gold foil; (h) die-cutting the polyester base film on the top surface thereof so as to form a predetermined shape on the polyester base film; (i) applying an amount of liquid epoxy on the binder layer, the liquid epoxy spreading on the binder layer so as to conform with the predetermined figure of the binder layer; and (j) drying the liquid epoxy to form a transparent epoxy layer.

First, a polyester (trade name: Tetoron) base film is provided and is electroplated so as to form a metal coating on the surface thereof. A hot-melt adhesive is coated on a bottom surface of the polyester base film so as to form a hot-melt adhesive layer on the bottom surface. A release paper is attached to the hot-melt adhesive layer. Binder layers of predetermined figures are formed on some predetermined parts of the top surface of the polyester base film by printing the top surface with a binder which will bind an epoxy layer to the metal coating on the polyester base film. Predetermined patterns can be printed on the remaining parts of the top surface of the polyester base film by pressing the remaining parts with ink and then with gold foil. After die-cutting, rough decorative stickers with predetermined shapes are formed. An amount of liquid epoxy is dripped on each binder layer and spreads on the binder layer so as to conform with the predetermined figure of a respective binder layer. Finally, the resultant product is placed in a drying oven in order to dry the liquid epoxy and form transparent epoxy layers. Therefore, with the manufacturing method of this invention, each decorative sticker has a predetermined shape and includes a polyester base film which is covered with a metal coating, a hot-melt adhesive layer attached to a bottom surface of the polyester base film, a release paper attached to the hot-melt adhesive layer, a binder layer with a predetermined figure provided on a predetermined part of a top surface of the polyester base film, a transparent epoxy layer formed on the binder layer, and a printed pattern of ink and gold foil provided on the remaining part of the top surface.

The polyester base film has a high heat resistance with respect to the PVC base film and does not melt till a temperature of about 180° C. is reached. A polyester base film, which has a thickness of 20$\mu$ and which is thinner than the 100$\mu$ PVC base film used in the conventional decorative sticker, can be covered directly with a heated hot-melt adhesive without damaging the base film. Furthermore, no additional device is required to control the manufacturing temperature. The hot-melt adhesive has a strong adhesive force so that each decorative sticker can be attached firmly to clothes when the hot-melt adhesive layer of each decorative sticker is detached from the release paper and is attached to clothing. An iron is used to iron the clothes at the place where the decorative sticker was attached so as to facilitate the attachment of the decorative sticker. The decorative stickers made in accordance with the present invention do not detach easily from clothes even after frequent washing of the clothes.

Owing to the high heat resistance of the polyester base film, the additional device for controlling the manufacturing temperature is not required when printing a desired pattern on the top surface of the polyester base film with gold foil.

With the provision of the binder layer, epoxy can be applied easily and securely to the metal coating on the top surface of the polyester base film. With the provision of the metal coating, which can sparkle in the presence of bright light, and the transparent epoxy layer which covers the metal coating, each decorative sticker can provide a crystalline effect that cannot be provided by conventional decorative stickers.

It has thus been shown that the decorative stickers can be made without the need for an additional device, which is used to control the manufacturing temperature in order to prevent damage of the polyester base film, as otherwise required in the prior art. In addition, each decorative sticker which is made by the manufacturing method of this invention includes a thin base film and an adhesive layer with a strong adhesive force and can provide a crystalline effect.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A method for making a decorative sticker, comprising the steps of:

providing a polyester base film which has a top surface and a bottom surface;

applying a metal coating on said polyester base film by electroplating so that said top and bottom surfaces of said polyester base film sparkle in the presence of bright light;

applying a hot-melt adhesive layer on said bottom surface of said polyester base film;

attaching a release paper to said hot-melt adhesive layer;

applying a binder layer with a figure on a part of said top surface of said polyester base film;

die-cutting said polyester base film on said top surface thereof;

applying an amount of liquid epoxy on said binder layer, said liquid epoxy spreading so as to conform with the figure of said binder layer; and drying said liquid epoxy so as to form a transparent epoxy layer.

2. A method as claimed in claim 1, further comprising the step of printing a pattern on the remaining part of said top surface of said polyester base film after applying said binder layer.

3. A method as claimed in claim 2, wherein said printing step includes pressing said remaining part of said top surface of said polyester base film with ink and pressing said remaining part of said top surface of said polyester base film with gold foil.

* * * * *